US005383243A

United States Patent [19]

Thacker et al.

[11] Patent Number: 5,383,243

[45] Date of Patent: Jan. 24, 1995

[54] DUCT BRUSH

[76] Inventors: Gregory Thacker; Patsy Thacker, both of 369 Biggs Branch, Pikeville, Ky. 41501

[21] Appl. No.: 202,837

[22] Filed: Feb. 28, 1994

Related U.S. Application Data

[63] Continuation-in-part of Ser. No. 982,638, Nov. 27, 1992, abandoned.

[51] Int. Cl.[6] ..... B08B 9/02

[52] U.S. Cl. ..... 15/104.18; 15/104.05; 15/104.16; 15/162; 15/169

[58] Field of Search ..... 15/104.05, 104.16, 104.18, 15/104.2, 104.33, 169, 186, 162

[56] References Cited

U.S. PATENT DOCUMENTS 4,247,964 2/1981 Lichliter ..... 15/104.18

*Primary Examiner*—Edward L. Roberts

[57] ABSTRACT

A duct brush for cleaning air conditioning and heating ducts. The brush is made up of a flexible hose connected to a cleaning head. The head is constructed to open like an umbrella for cleaning large duct areas. The opening and closing of the cleaning head are controlled by a plunger at the end of the hose held by the operator. In an alternatively preferred embodiment, a multiplicity of separate hose sections are connectable to each other end to end to from a hose of any desired length.

5 Claims, 5 Drawing Sheets 10
11
2
3

4
4
16
15
13
14
13
4
4
12

DUCT BRUSH

RELATED APPLICATION

This application is a continuation-in-part of prior copending application, Ser. No. 07/982,638, filed Nov. 27, 1992 now abandoned.

BACKGROUND OF THE INVENTION

1. Field of the Invention

The present invention relates generally to a duct-cleaning apparatus, and more particularly, to a duct brush containing connected sections of flexible hoses attached to a cloth cleaning head.

2. Description of the Prior Art

Devices for cleaning ducts are well known in the art. Thus, U.S. Pat. No. 5,020,188 discloses a device which fits inside the ductwork and discharges cleaning fluids under pressure onto the duct walls. This apparatus creates a considerable amount of fluids which must be evacuated by a vacuum exhaust pump. The device disclosed in U.S. Pat. No. 4,984,329 contains an outer hose, an inner hose, a turbine, and a brush. Thus, this apparatus is expensive to manufacture because of its many parts. The device disclosed in U.S. Pat. No. 4,656,685 contains a hose, a brush, a nozzle for dispensing cleaning fluids onto the duct walls, and a sponge. Here, again, large quantities of cleaning fluids must be disposed of, making the cleaning process awkward and time-consuming. The duct cleaning device disclosed in U.S. Pat. No. 3,994,310 contains two jets for loosening and removing debris attached to the duct. This device is complicated in its manufacture and requires the removal of large amounts of dirty fluid in the process of cleaning the ductwork. U.S. Pat. No. 3,882,566 discloses a method of cleaning ducts by dragging a cleaning element through the ductwork by means of a dragline. This method employs a plurality of cleaning elements of varying sizes.

Thus, while the foregoing body of prior art indicates it to be well known to use various forms of duct cleaning apparatuses, the provision of a simple and cost effective duct cleaning device is not contemplated. Nor does the prior art described above teach or suggest a simple, inexpensive, but effective apparatus for cleaning ductwork. The foregoing disadvantages are overcome by the novel duct cleaning apparatus of the present invention as will be made apparent from the following description thereof. Other advantages of the present invention over the prior art also will be rendered evident.

SUMMARY OF THE INVENTION

To achieve the foregoing and other advantages, the present invention. briefly described, provides a duct brush for cleaning air conditioning and heating ducts or the like. The brush is made up of a flexible hose connected to a cleaning head. The head is constructed to open like an umbrella for cleaning large duct areas. The opening and closing of the cleaning head are controlled by a plunger at the end of the hose held by the operator. In an alternatively preferred embodiment, a multiplicity of separate hose sections are connectable to each other end to end to from a hose of any desired length.

The above brief description sets forth rather broadly the more important features of the present invention in order that the detailed description thereof that follows may be better understood, and in order that the present contributions to the art may be better appreciated.

There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting. As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved duct cleaning device which has all of the advantages of the prior art and none of the disadvantages.

It is another object of the present invention to provide a new and improved duct cleaning device which may be easily and efficiently manufactured and marketed.

It is a further objective of the present invention to provide a new and improved duct cleaning device which is of durable and reliable construction.

An even further object of the present invention is to provide a new and improved duct cleaning device which is susceptible of a low cost of manufacture with regard to both materials and labor, and which accordingly is then susceptible of low prices of sale to the consuming public, thereby making such duct cleaning device available to the buying public.

Still yet a further object of the present invention is to provide a new and improved duct brush.

It is still a further object of the present invention is to provide a new and improved duct brush, the size of which may be easily adjusted to conform to the size of the duct being cleaned.

Still a further object of the present invention is to provide a new and improved duct brush including means for rotating the brush so that greater cleaning of the ductwork may be achieved.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

With reference now to the drawings, a new and improved duct brush embodying the principles and concepts of the present invention will be described.

Figure 1:
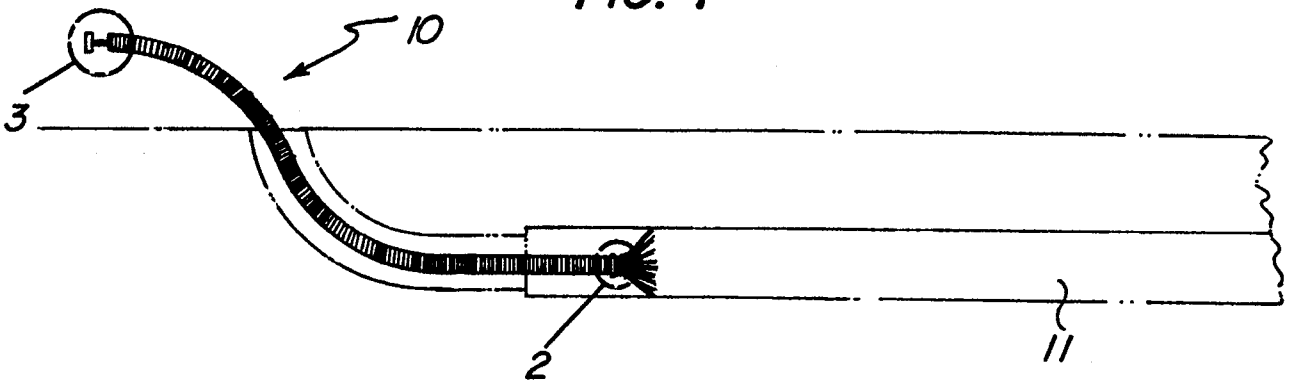
FIG. 1 is an elevational side view of the duct brush of the present invention as it would be positioned while in use.

Turning initially to FIG. 1, the duct brush 10 of this invention is portrayed as it is positioned in a duct 11. The distal end 2 of the brush is pictured as being located in a duet and in the opened position for cleaning. The proximal end 3 portrays the plunger handle, which may be used to selectively activate and control the size of the distal end of the brush.

Figure 2:
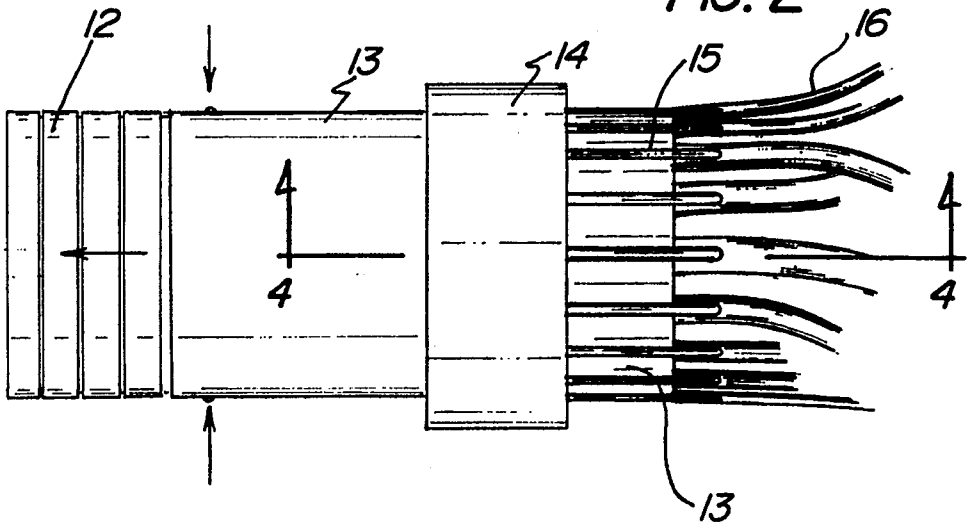
FIG. 2 is an elevational side view of the distal end (end away from the operator) of the dust brush showing the brush mechanism in detail.

FIG. 2 offers an enlarged view of the distal end of the brush for a better understanding of the invention. A flexible hose 12 ends in an inflexible circular end 13. A ring 14 is slidably attached to the inflexible end 13. Extender arms 15 are attached at proximal ends by hinge assemblies 33 to the outer end of the ring 14. The extender arms 15 are attached at distal ends to cloth swabs 16 in the central portion of the cloth swabs 16.

In a preferred embodiment of this invention, a conventional dust attractor, such as furniture polish, is sprayed on the cloth swabs in order to increase the efficiency of the device. The extender arms are preferably made of hard rubber, although any conventional inflexible and durable material, such as plastic, may be used.

Figure 3:
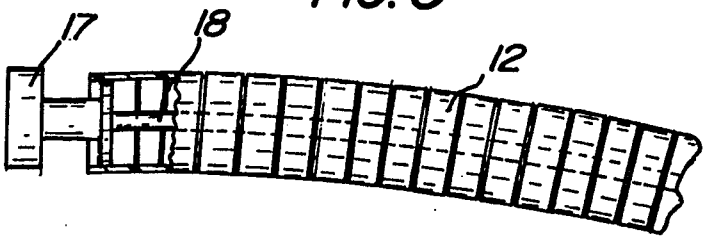
FIG. 3 is a partially cut-away side elevational view of the proximal end (end closest to the operator) of the dust brush showing the plunger in detail.

FIG. 3 shows the proximal end of the device in detail. The flexible hose 12, usually of plastic construction, terminates at the proximal end with a plunger head 17, which is attached to, and controls the position of, a centrally located flexible plunger 18. Plunger 18 is supported for axial movement within flexible hose 12 by suitable means such as a fixed bracket or series of spaced brackets each having a central hole therein.

Figure 4:
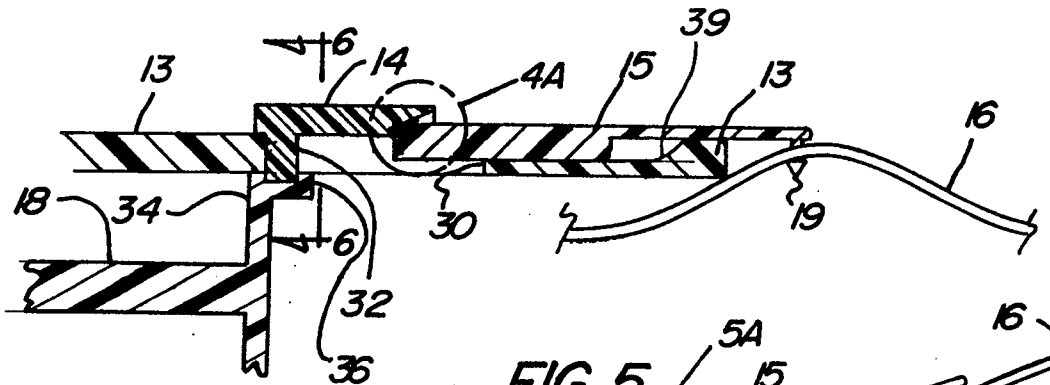
FIG. 4 is a sectional view taken along line 4—4 of FIG. 2 and shows one side of the hose at the distal end, showing the relationship between the hose, the ring, the extender arm and the cloth swab when the ring is in a proximal position.
Figure 5:
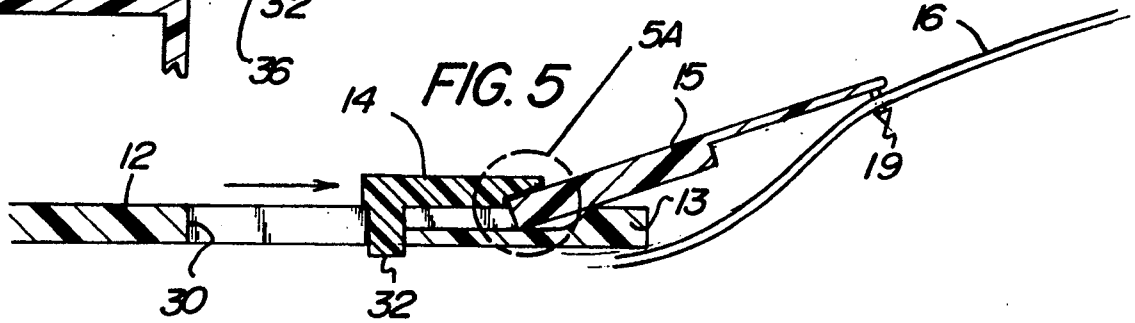
FIG. 5 is a cross-sectional view of one side of the hose at the distal end, showing the relationship between the hose, the ring, the extender arm and the cloth swab when the ring is in a distal position.
Figure 4A:
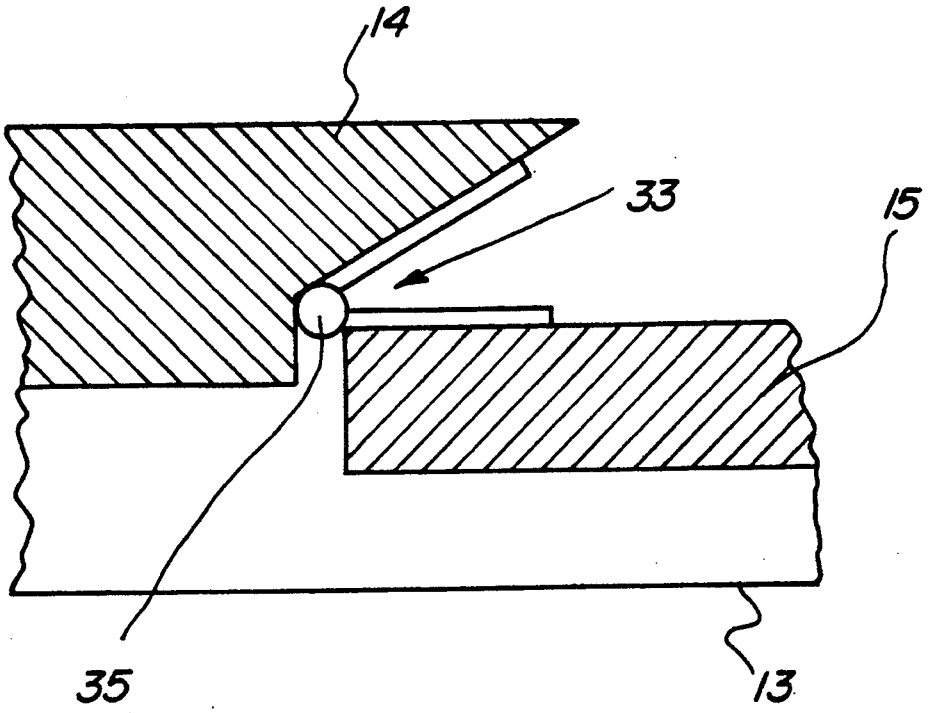
FIG. 4A is an enlarged view of the circled region 4A in FIG. 4.
Figure 5A:
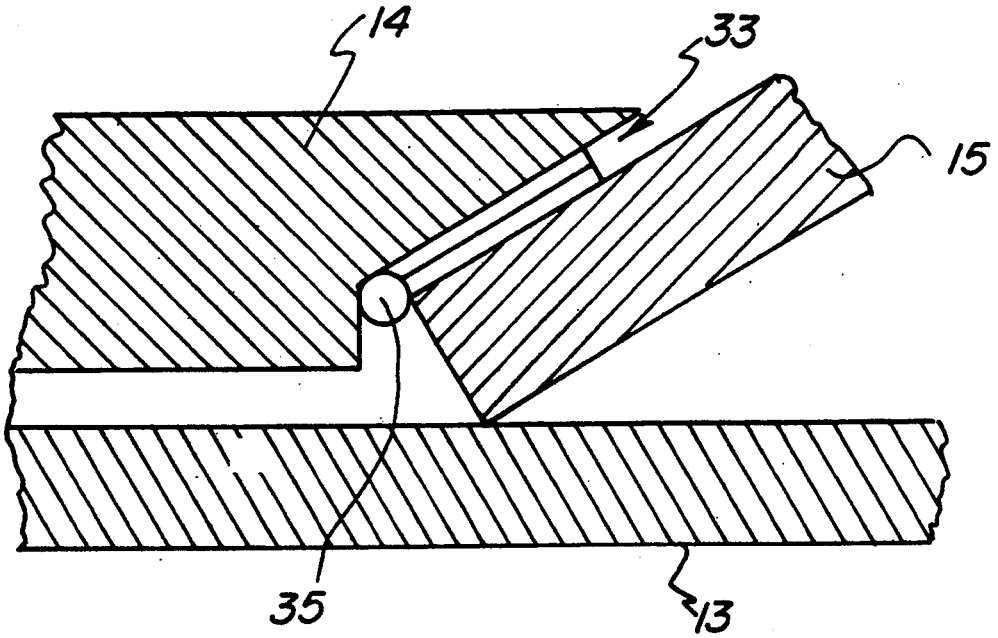
FIG. 5A is an enlarged view of the circled region 5A in FIG. 5.

FIGS. 4 and 5 show the distal end in greater detail. Just proximal to the distal tip of the inflexible end 13 of the hose 12, the wall of the inflexible end 13 is thin to accommodate the presence of the extender arm 15. At the distal tip of the inflexible end 13 of the hose 12, the wall curves outwardly and distally so that, as the extender arms 15 are forced distally by the distal movement of the ring 14, they are also forced outwardly. As the extender arms 15 are forced outwardly by the motion of the ring 14 and the curved wall surfaces 39 at the distal tip of the inflexible end 13 of the hose 12, the extender arms 15 pivot around the hinge pins 35 of the hinge assemblies 33 which connect the proximal ends of the extender arms 15 to the ring 14. Conversely, when the ring 14 is pulled proximally, the extender arms 15 are pulled proximally by the hinge assemblies 33 that connect the extender anus 15 to the ring 14. As the extender arms 15 move proximally, they move against the curved wall surfaces 39 of the distal end 13 of the hose 12 and, thereby move inwardly. As the extender arms 15 move inwardly, they pivot around the hinge pins 35 of the hinge assemblies 33.

The hinge assemblies 33 are connected to the ring 14 and the extender arms 15 by conventional means such as adhesives or fasteners such as screws, rivets, or staples, among others.

Since the distal ends of the extender arms 15 are attached to the cloth swabs 16 by a snap-in button 19, when the extender arms 15 are extended outwardly, the cloth swabs 16 are also extended outwardly. The term outwardly means radially extended with respect to the central longitudinal axis of the hose as substantially shown in FIGS. 4 and 5. The extension allows the cloth swabs 16 to contact the walls of larger ducts. The extender arms 15 may be returned to their original location on the inflexible end 13 of the hose wall 12 either by being pulled proximally by the ring 14 which is pulled by the plunger 18 or by being forced inwardly (and therefore proximally) when the duct brush 10 is withdrawn through a duct having a smaller diameter than the extended extender arms 15. It will be noted that the distal movement of ring 14 is limited by the provision of axial slots 30 located in hose end and suitable protrusions 32 depending radially inwardly from ring 14 and extending into each slot, respectively. Protrusions 32, in turn, are suitably engaged by the distal end of plunger 18 as, for example, via a washer 34 affixed to the distal end of the plunger and integral clip 36 suitably engaging the protrusion.

Figure 6:
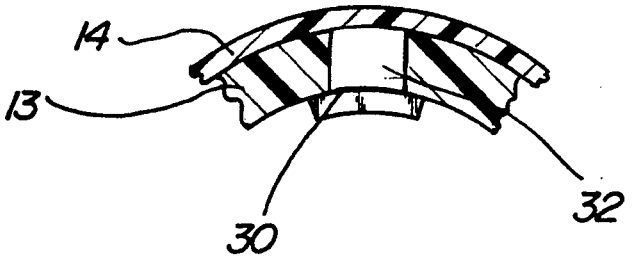
FIG. 6 is a sectional view taken along line 6—6 of FIG. 4.

FIG. 6 shows the preferred simple relationship between the ring 14, the inflexible distal end 13 of the hose wall and the extender arm 15.

Figure 7:
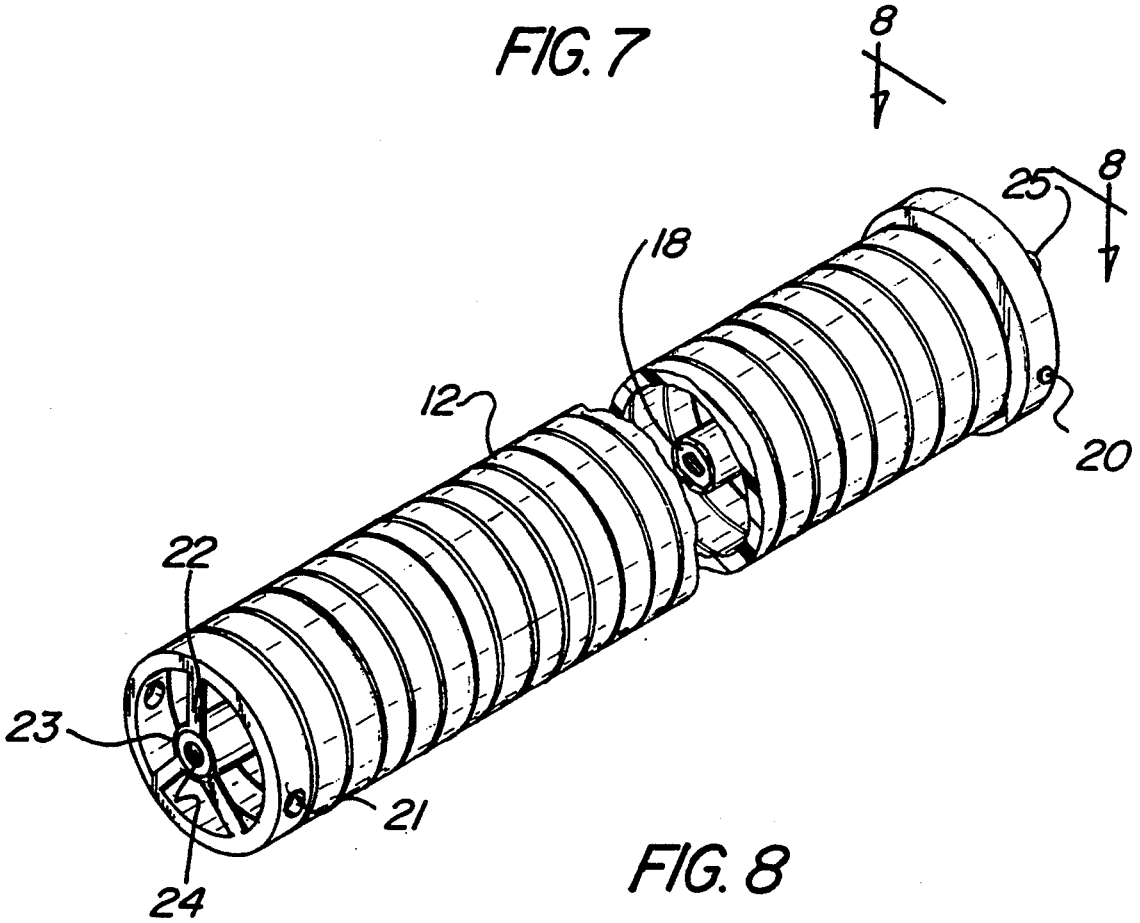
FIG. 7 is a perspective view of an alternatively preferred embodiment of the invention in the form of individual sections of the hose adapted to be axially connected to each other.
Figure 8:
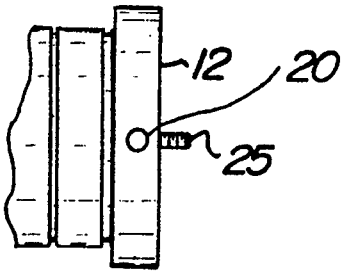
FIG. 8 is a view through line 8—8 of FIG. 7 showing the male connector element and the button element of a button and hole clip-in connection.

FIGS. 7 and 8 disclose an alternatively preferred method of connecting separate individual sections of the flexible hose 12 together to form a hose of any desired length or axial extent. Each separate section of hose 12 has at least one hole 20 and corresponding detent button 21. Each section of the hose 12 may contain a plurality of supporting arms 22 which support a centrally located ring 23. A plunger section 18 is adapted for slidable movement axially within ring 23. At one end of each plunger section 18, there is a female threaded connector 24 and at the other or opposed end, a male threaded connector 25. The size and shape of the centrally located ting 23 and the corresponding male and female connectors 25, 24 are such as to allow free, but supported axial passage of the plunger 18. As many individual hose sections 12 as necessary for a given duct work may be connected together end to end as is believed apparent.

Figure 9:
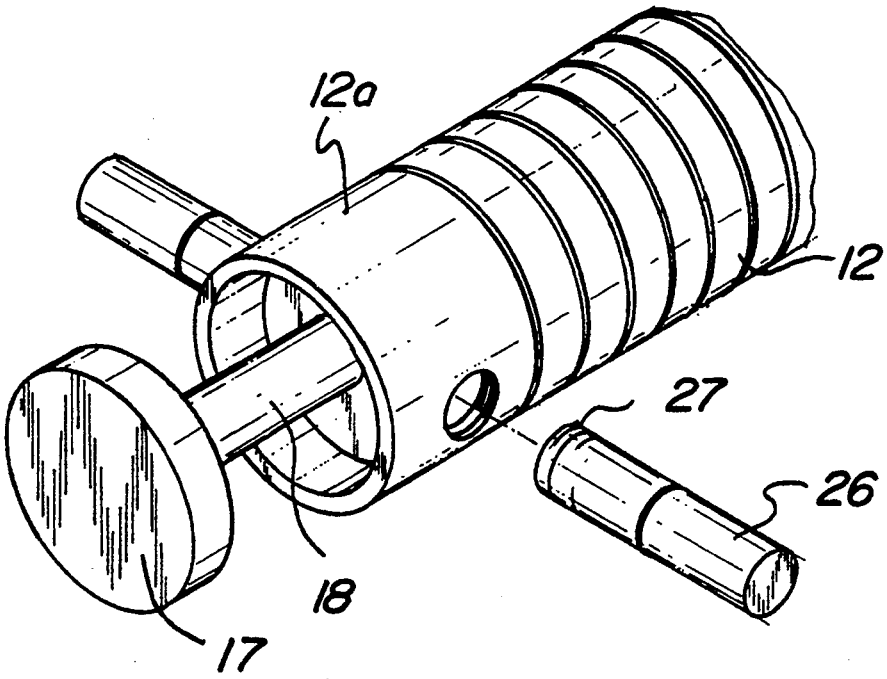
FIG. 9 is an elevational telescopic view depicting how a handle for turning the hose may be attached.

A preferred embodiment of the proximal end of the duct cleaner 10 is disclosed in FIG. 9. Handles 26 may be secured to the inflexible portion 13 of the hose 12 in order to facilitate rotation of the hose about its central longitudinal axis and therefore rotation of the cloth swabs 16 and thereby improve the cleaning efficiency of the device according to the invention. The handles may be attached by means of threads 27 or by a simple clip-in connector (not shown).

Figure 10:
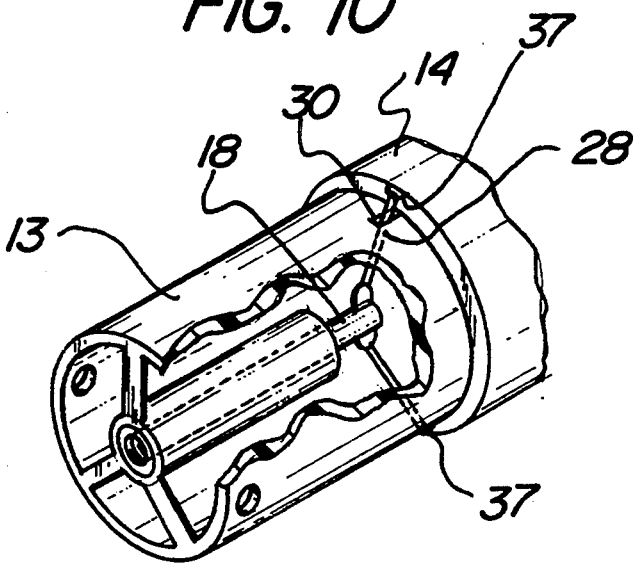
FIG. 10 is a cut-away view of the distal portion of the hose showing a preferred connection between the plunger and the ring as employed with the alternative embodiment of FIGS. 7 and 8.

FIG. 10 illustrates a preferred embodiment as to the connection between the plunger 18 and the ring 14 when the individual (separate) hose sections of FIGS. 7 and 8 are employed. In this embodiment the distal end of the plunger 18 is supplied with a plurality of connecting arms 28 which are rigidly connected at one end to the plunger 18 and at the other end, they pass through slots 30 in the distal end 13 of the hose 12 and are connected to the ring 14 by fastening staples 37 substantially as shown. This connection allows the forward and backward movement of the plunger 18 to be directly transmitted to the ring 14, and subsequently to the extender arms 15 and cloth swabs 16 as previously described.

From the above description, it can be readily appreciated that the duct brush of this invention can be used to remove substantially all of the dust and cobwebs from the ductwork system and thereby provide more efficient heating and cooling of a house while keeping the dust emanating from the ductwork system to a minimum. The duct brush of the present invention can be easily cleaned, stored in a small space, easily assembled, and used by non-professionals.

It is apparent from the above that the present invention accomplishes all of the objectives set forth by providing a new and improved duct brush of relatively simple and inexpensive construction.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A duct cleaning device, comprising:

a flexible hose, said hose having a proximal end, a distal end, an inner wall, and an outer wall, said distal end of said flexible hose having a plurality of circumferentially spaced axially extending slots therein near the extremity of said distal end, said distal end of said flexible hose having outwardly curved wall portions distal to said axially extending slots, a plurality of cloth swabs which are connected to the distal end of the flexible hose, each cloth swab having a free distal end, a free proximal end, and a center portion, a ring at the distal end of the hose, slidably surrounding the hose, a plurality of extender arms, each arm having a proximal end and a distal end, the proximal end of the extender arm being connected by a hinge assembly to said ring, said extender arm slidably engaged to the outer wall of the hose at the distal end thereof and the distal end of the arm being attached to the center portion of a cloth swab, said ring adapted so that when the ring is moved distally, said ring moves the extender arms to said outwardly curved wall portions of said distal end of said hose, such that said extender arms move distally and outwardly and so that when the ring is moved proximally, said hinge assemblies pull the extender arms proximally and said curved wall portions of said distal end of said hose permit the extender arms to move inwardly, and a flexible plunger supported for axial movement within said hose, said plunger comprising a proximal end, a body portion, and a distal end, the distal end of said plunger being connected to the ring in such a way that when the plunger is moved distally, the ring moves distally in said slots pushing the extender arms distally and when the plunger is moved proximally, the ring moves proximally in said slots whereby said hinge assemblies pull the extender arms proximally.

2. The duct cleaning device of claim 2 wherein the plunger is operatively coupled to the ring by means of connector arms mounted on the plunger, which arms have ends connected to the ring.

3. The duct cleaning device of claim 1 wherein said flexible hose is made up of a plurality of separate hose sections connected together end to end, each said separate hose section having a centrally located aperture forming ring and a separate plunger section supported in said ring for axial movement therein, each said separate plunger section having a female connector at one end and a male connector at its other end.

4. The duct cleaning device of claim 1 wherein said plunger includes handle means at its proximal end for moving said plunger distally.

5. The duct cleaning device of claim 4 wherein said proximal end of said hose includes handle means for facilitating rotation of said hose about its central longitudinal axis.

* * * * *